United States Patent [19]

Viger

[11] Patent Number: 4,827,690

[45] Date of Patent: May 9, 1989

[54] CARDBOARD BUILDING STRUCTURE AND METHOD

[75] Inventor: Philippe Viger, St-Paul de l'Ile-aux-Noix, Canada

[73] Assignee: François Forget, Montreal, Canada

[21] Appl. No.: 119,959

[22] Filed: Nov. 13, 1987

[51] Int. Cl.[4] ..... E04C 2/00

[52] U.S. Cl. ..... 52/782; 52/785; 52/300; 52/577

[58] Field of Search ..... 52/90, 785, 576, 577, 52/696, 782, 785, 300, 577; 206/586; 428/36, 188

[56] References Cited

U.S. PATENT DOCUMENTS

| | | | |
|---|---|---|---|
| 2,609,136 | 9/1952 | Sider | 206/586 |
| 2,762,550 | 9/1956 | Goettsch et al. | 206/586 |
| 3,394,525 | 7/1968 | McKee et al. | 52/726 |
| 3,747,290 | 7/1973 | Barrell et al. | 52/90 |
| 4,001,993 | 1/1977 | Daniels | 52/660 |

FOREIGN PATENT DOCUMENTS

| | | | |
|---|---|---|---|
| 966631 | 4/1974 | Canada | 52/90 |
| 646939 | 11/1950 | United Kingdom | 52/577 |

*Primary Examiner*—James L. Ridgill, Jr.

[57] ABSTRACT

A cardboard structural member for use in the construction of building panels and a method of making same. The structural cardboard member comprises an elongated hollow channel member of rectangular cross-section formed of corrugated cardboard sheeting. The channel member defines opposed parallel walls and is opened at its ends. One pair of parallel walls terminates short of the ends of the structural cardboard member to define a connecting channel across the ends for receiving a rigid structural member thereacross between two opposite walls when assembling the panels to construct a building structure. The method of assembly consists in glueing a plurality of these structural members side by side to form the panels.

13 Claims, 4 Drawing Sheets

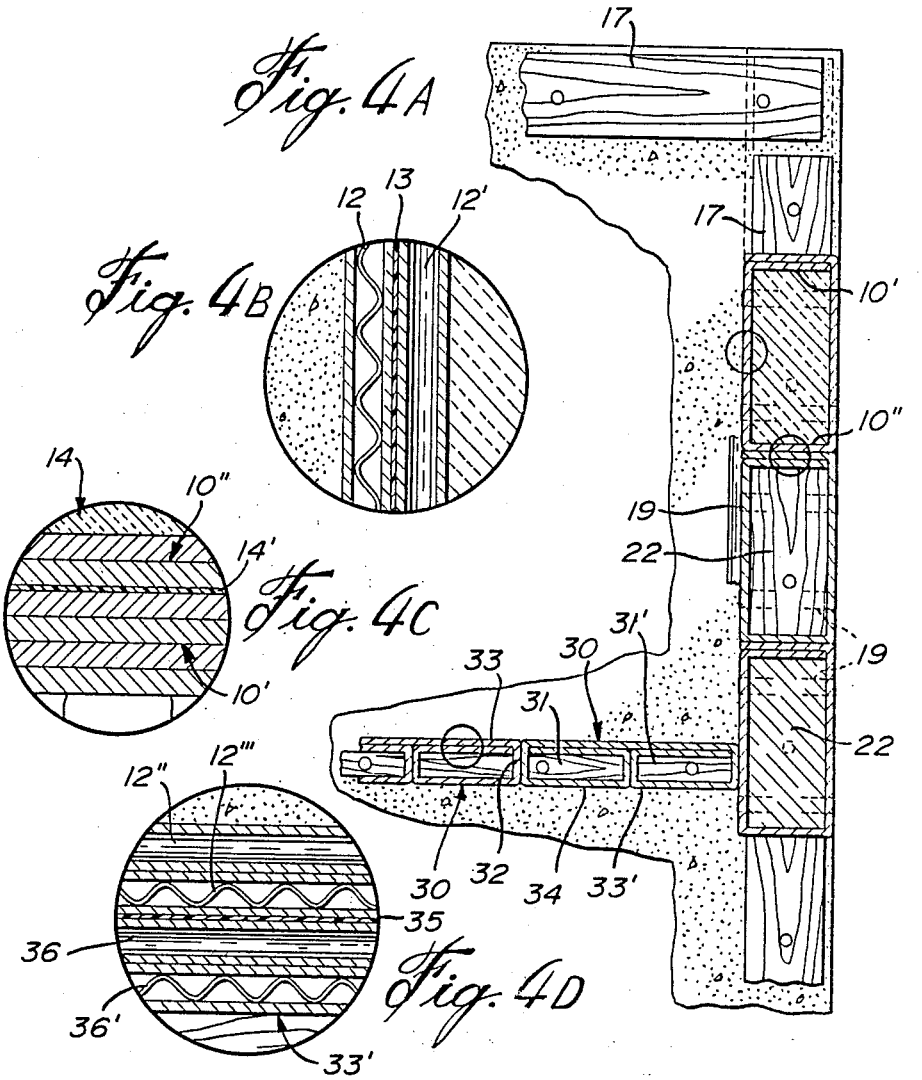
Fig. 4A
Fig. 4B
Fig. 4C
Fig. 4D
17
17
10'
10"
19
22
19
22
12
13
12'
14
10"
14'
10'
12"
12'''
35
36
36'
33'
31'
33
30
31
30
32
34
33'
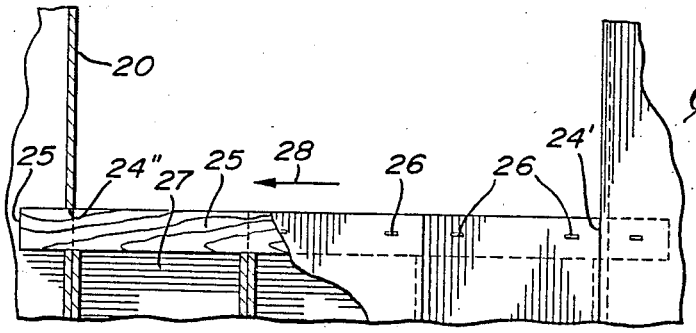
Fig. 5B
20
25
24"
27
25
28
26
26
24'

10
10'
10"
60
60'
61
61'
62
62'
63
63'
64
69
70
70'
71
72
73
74
75
30

CARDBOARD BUILDING STRUCTURE AND METHOD

BACKGROUND OF INVENTION

1. Field of Invention

The present invention relates to structural cardboard members which are used to form panels for the construction of building structures, and to the method of forming cardboard structural panels.

2. Description of Prior Art

It is known to incorporate cardboards such as corrugated cardboard sheeting in construction materials to make panels for the reason that corrugated cardboard exhibits strong properties due to the corrugations sandwiched between opposed cardboard layers. However, the use of cardboard has heretofore had limited applications, although cardboard is known to possess various advantages over many other building materials, and one main advantage is the light weight of the product.

SUMMARY OF INVENTION

It is therefore a feature of the present invention to provide structural cardboard members which are used in the construction of building panels for the construction of building structures.

Another feature of the present invention is to provide a cardboard structural member for use in the construction of vertical partition walls in a building structure, and wherein such structural members are glued in end-to-end relationship.

Another feature of the present invention is to provide cardboard structural member for use in the construction of building panels which are lightweight, easy to manipulate, easy to assemble, and economical to produce and assemble.

Another feature of the present invention is to provide a cardboard structural member which provides excellent thermal and acoustic insulating properties.

Another feature of the present invention is to provide a novel method of forming cardboard structural panels for the construction of cardboard building structures.

According to the above features, from a broad aspect, the present invention provides a structural cardboard member for use in the construction of building panels for walls, roofs, ceilings and the like. The structural cardboard member comprises an elongated hollow channel member of rectangular cross-section formed of corrugated cardboard sheeting. Securement means is provided for retaining the cardboard sheeting as an elongated channel member of rectangular cross-section. The channel member has opposed parallel walls and is opened at its ends. One pair of the parallel walls terminates short of the ends to define a connecting channel across the ends, between opposed parallel side walls, for receiving a rigid structural member thereacross when assembling the panel to form a building a structure.

According to a still further broad aspect of the present invention there is provided a cardboard structural member for use in the construction of vertical partition walls in a building structure. The structural member comprises a narrow elongated channel member of rectangular cross-section formed of corrugated cardboard sheeting bent to form two intermediate hollow channels positioned side by side. The structural member defines opposed narrow end walls and wide side walls. One of the side walls has a double layer of the corrugated cardboard secured together. An intermediate vertical transverse support wall is also formed of a double layer of the corrugated cardboard secured together.

According to a still broad aspect of the present invention there is provided a method of forming cardboard structural panels for the construction of cardboard building structures. The method comprises bending a rectangular corrugated cardboard sheet about longitudinal opposed parallel walls of a carrier member of rectangular cross-section. Glue is applied to an end panel portion of the cardboard sheet to overlap and glue same to a previously bent panel along an end one of the walls of the carrier member to form a double ply end wall. Two or more of the carrier members and surrounding cardboard sheets are disposed between two pressure plates with the double-ply end wall extending transversely of the pressure plates. Glue is applied to an outside surface of the double-ply end wall or its opposed end wall. Pressure displacement is then applied from the end wall having no glue whereby to apply bonding pressure between a single-ply cardboard end wall about one of the two or more carrier members and an adjacent double-ply end wall whereby to form a triple-layer vertical support wall. The carrier members are then extracted from their surrounding cardboard sheets glued side by side, and the hollow cardboard channel members thus formed by glueing them together side by side are removed to constitute a cardboard structural panel.

BRIEF DESCRIPTION OF DRAWINGS

A preferred embodiment of the present invention will now be described with reference to the examples thereof as illustrated in the accompanying drawings, in which:

FIG. 4A is a top section view showing the building panels being assembled on the floor of a building structure;

FIG. 4B is an enlarged view of a side wall of the cardboard structural member;

FIG. 4C is an enlarged view showing the bonding of opposed end walls of opposed structural members;

Figures 1, 2, 3, 5A:
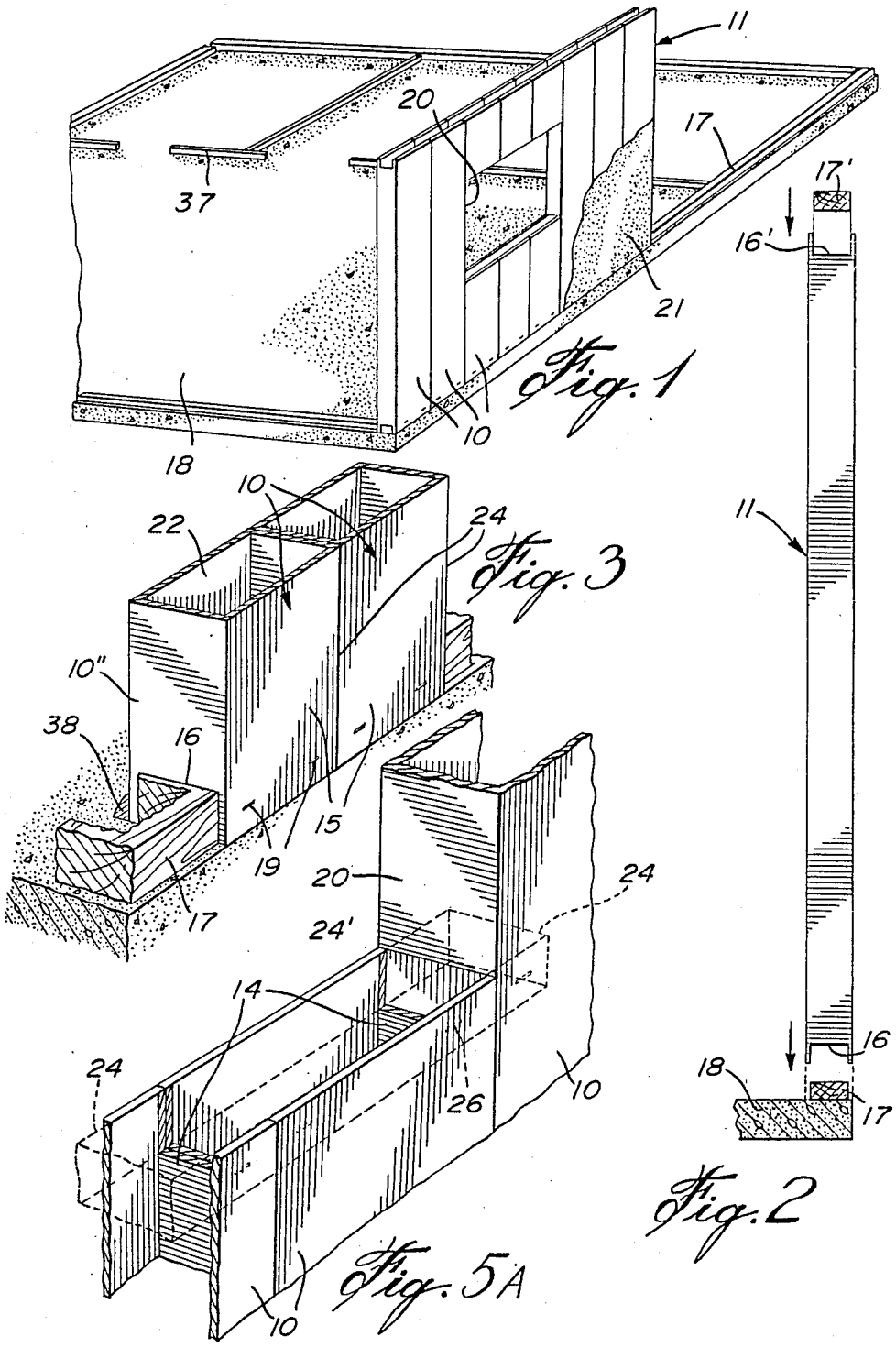
FIG. 1 is a perspective view showing a building structure being constructed of a building panel formed with structural cardboard members of the present invention.
FIG. 2 is an end view showing how a building panel of the present invention is secured in the construction of a building.
FIG. 3 is a fragmented bottom end view of the building panel illustrated in perspective.
Figure 6:
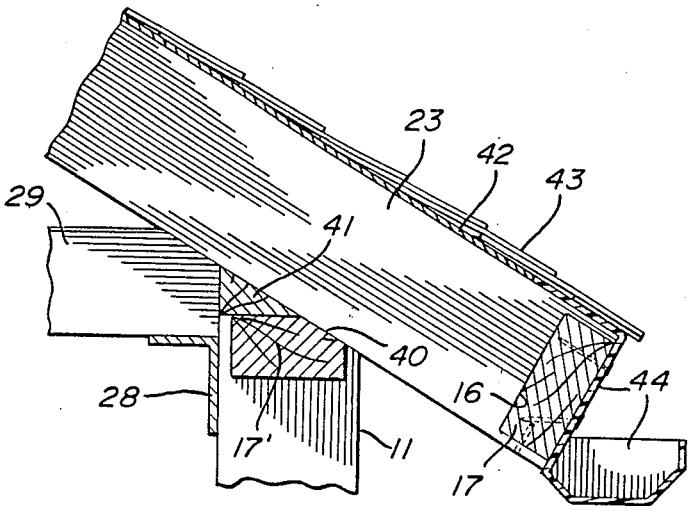
Figure 7:
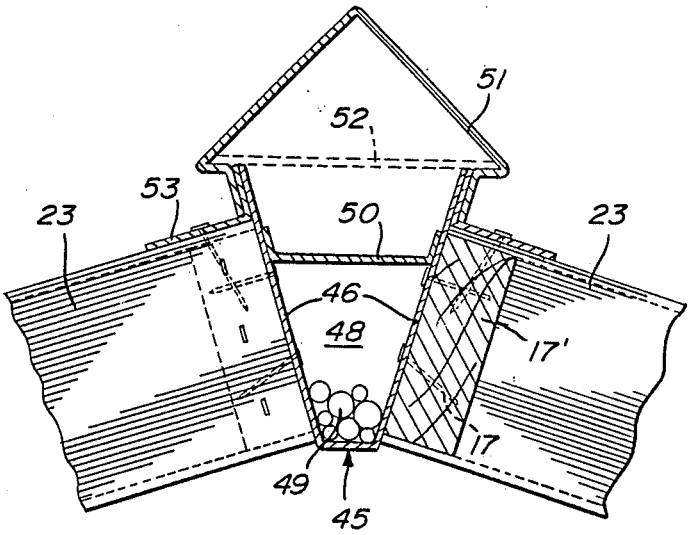
Figures 8A, 8B, 8C, 8D, 8E, 9, 10:
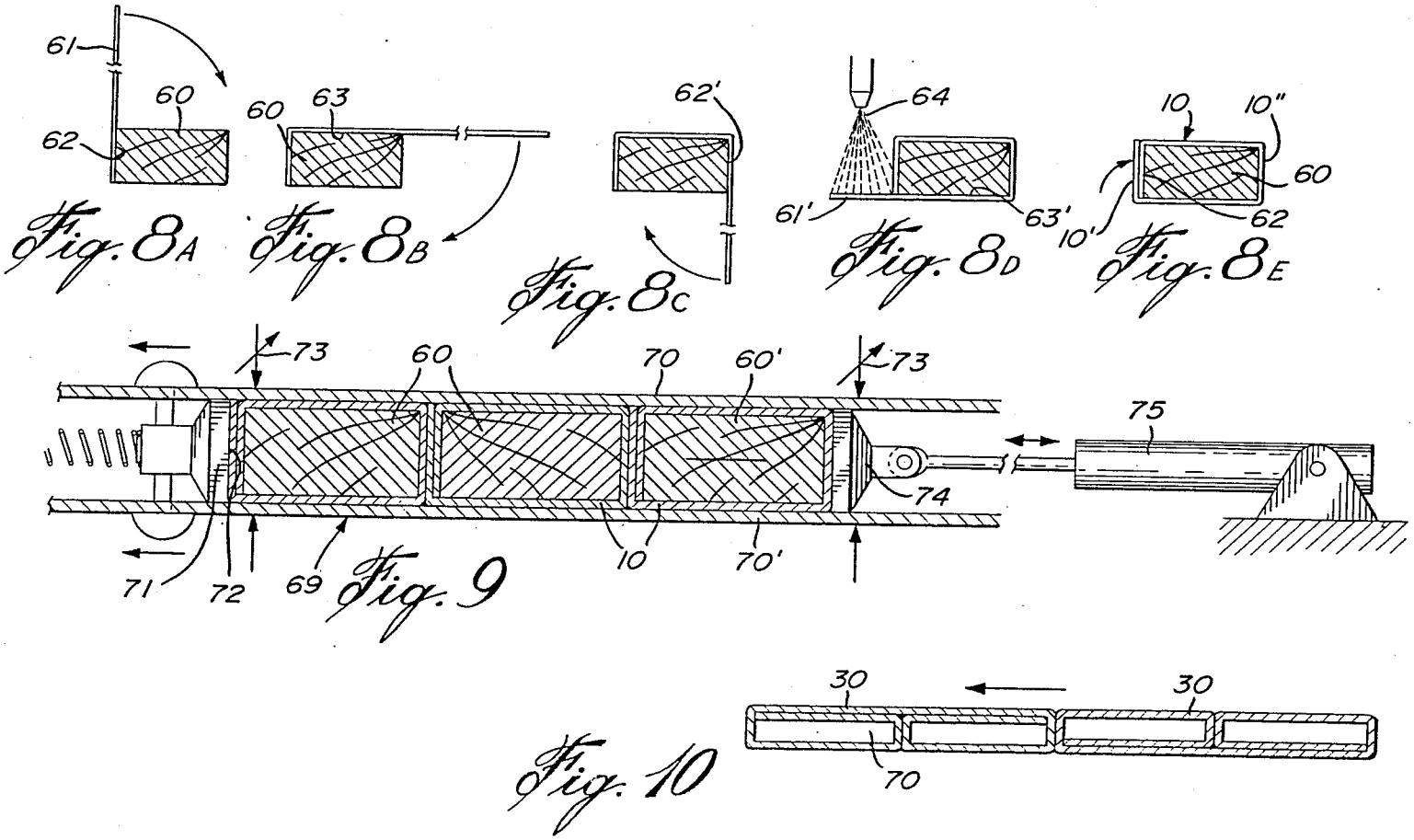

FIG. D is an enlarged view showing the construction of vertical partition walls constructed in accordance with the present invention;

FIG. 5A is a perspective fragmented view showing how a window opening with sill member is formed in the building panels;

FIG. 5B is a fragmented plan view showing a window opening and the position of a sill member;

FIG. 6 is a fragmented section view showing the use of the building panels as vertical walls and roof panels;

FIG. 7 is a fragmented section view showing the construction of an apex bracket used in the construction of V-shaped roofs;

FIGS. 8A to 8E are schematic illustrations of the method of forming the structural cardboard member;

FIG. 9 is a simplified schematic view showing the method of forming cardboard structural panels using the structural cardboard members; and FIG. 10 is a simplified cross-section view showing the same method for the construction of building panels utilized for vertical partition walls.

DESCRIPTION OF PREFERRED EMBODIMENTS

Referring now to the drawings, and more particularly to FIGS. 1 to 4D, there is shown a cardboard structural member 10 constructed in accordance with the present invention and glued edge to edge with adjacent cardboard structural members to form a building panel 11, as shown in FIG. 1, which is used for the construction of walls, roofs, ceilings, or the like structures in the construction of a building structure. As illustrated more clearly in FIGS. 3 and 4A to 4D, each cardboard structural member 10 is formed as an elongated hollow channel member of rectangular cross-section made of corrugated cardboard sheeting consisting of corrugated cardboard sandwiched between two sheets. Each of the structural members 10 is shaped in this configuration by a method of making same, as will be described later with reference to FIGS. 8 and 9. This results in a rectangular hollow channel member having an end wall 10' which is a double-ply structural transverse wall, and an opposed end wall 10'' which is of a single ply of the cardboard sheeting. It is pointed out that the cardboard sheeting itself consists of a two-ply corrugation 12 and 12' bonded together by a suitable water-resistant adhesive 13 see FIGS. 4A to 4D). Once the end walls are bonded together it results in interconnecting walls having three plies of cardboard material formed with a glue seam 14' resulting in six plies of corrugations.

In the configuration of the cardboard structural member 10 shown in the drawings, the member defines wide side walls 15 and narrow end walls 10' and 10'', and the hollow channel members have opposed open ends. The ends of the channel members also have the wide side walls 15 extending a predetermined distance above the end walls 10' and 10'' to define therebetween a connecting channel 16 for receiving therein a rigid structural member, such as a wooden beam 17 and 17' when the cardboard structural member 10 is assembled in a panel 11, as shown in FIG. 1. It is also pointed out that the cardboard structural member 10 is impregnated with a waterproofing substance, as is well known in the art, whereby to prevent the ingress of moisture.

It is also pointed out that corrugated cardboard is very strong along its planar axis, and in the embodiment shown in FIGS. 4A to 4D it is seen that the corrugations of the layers 12 and 12' are disposed transversely of the longitudinal axis of the structural members 10. It is also within the ambit of the present invention to provide one of the layers 12 or 12' disposed horizontally and the other layer transverse thereto. Such an orientation of the corrugations is illustrated at 12'' and 12''' in FIG. 4, and it provides better sound absorption. Thus, the hollow structural members have a good sound absorption property as well as good thermal absorption property due to the air channels formed by the corrugations and the hollow space within the structural member.

It is also pointed out that the panels 11 are assembled quickly and easily by placing the lower channel 16 over a wooden piece 17 secured in position along an outer edge of a building floor structure 18. This wooden member 17 is of the type commonly found in construction materials and the channels 16 and 16' are also dimensioned to fit over the standard wooden beams. When the panel 11 is positioned over the beam, as shown in FIG. 3, fasteners, such as staples 19, secure the panel to the beam from opposite sides of the channel 16. After wall sections of the building structure are thus assembled window areas, such as that shown at 20, are cut out of the panels by the use of an appropriate knife. As also shown in FIG. 1, the walls may later be covered with a finishing product, such as stucco, or other exterior covering.

Another advantage of using cardboard structural panels is that these are very light and consequently very large panel spans can be handled by only a few construction workers. Also, the manner in which the panel is secured to the floor structure is simple and rapid. Accordingly, a small building structure can be totally erected in very little time. After the walls are mounted in position, the hollow space 22 within the structural members 10 may be filled with an insulation, either a wool or granular type insulation. It is also conceivable that these hollow spaces 22 could be filled with sand or even concrete to constitute a hard wall structure. However, when using concrete proper structural metal rods should be used to tie the panels to the floor structure, and such provision is obvious to a person skilled in the art. After the insulation or the fill, if desired, within the hollow area 22 is inserted, the top structural edge beam 17' is then placed in the top channel 16' and secured therein by staple fasteners. A roof panel structure, such as shown at 23 in FIG. 6, can then be installed. Of course, when these panels 11 re in position glue is applied to the outer edges of the panels to secure them together. Also, a glue tape can be applied to the joints 24 between each of the structural members 10 to conceal the joint particularly if a covering such as 21 is applied to the outer surface, or if the inner surfaces are painted or plastered. An advantage of the cardboard is that there is no movement and cracking, usually resulting when using humid lumber. Thus, no cracks develop after settling.

Referring now to FIGS. 5A and 5B, there is shown the construction of a window opening, such as that shown at 20. When the window opening 20 is cut from the panel 11 the lower and upper triple layer walls 14 in the opening are notched to form a channel 24 whereby to receive therein a sill member 25, herein constituted by an elongated wooden beam of rectangular cross-section. This provides the window sill and adds rigidity to the opening 20 for support and for attachment of a window frame (not shown) which is fitted in the opening 20. In the case of a door opening (not shown), such a sill would be provided in the top edge of the door opening. These sill members are also secured by fasteners 26, such as staple fasteners. As also shown in FIG. 5B, the insulation 27 is positioned within the hollow channels 22 prior to the insertion of the sill member 25. To insert the sill member 25 one end of the sill member is pushed through the rectangular opening 24' formed at the end of the channel 24 until the rear end 25' of the wooden piece lies within the opening 20. This rear end 25' is then positioned in the opposite opening 24'' and the wooden piece is slid back in the direction of arrow 28, as shown in FIG. 5B. Thus, the wooden beam 25 is supported by all of the vertical wall sections 14 lying thereunder, and namely four vertical wall sections of triple corrugated layers, as shown in FIG. 5B.

Referring now more particularly to FIGS. 4A to 4D, there is also shown the construction of a cardboard structural member 30 which is used in the construction of vertical partition walls disposed inside a building structure, as herein illustrated. This structural member is slightly different from the structural member 10, and it consists of a narrow elongated channel member, also of rectangular cross-section, formed of corrugated cardboard sheeting which is bent to constitute two intermediate hollow channels 31 and 31' positioned side by side. The structural member 30 defines opposed narrow end walls 32 and wide side walls 33. One of the side walls, namely 33', is constituted of a double layer of corrugated cardboard secured together. The partition wall structural member 30 also has an intermediate vertical transverse support wall 34 formed of a double layer of corrugated cardboard secured together.

As shown in the exploded view, the double-layer side wall 33' consists of two cardboard layers secured together by a glue seam 35. Also, each of the cardboard layers has the corrugations 36 and 36' extending transverse to one another whereby to provide excellent sound absorption qualities which are required inside the building structure between various rooms formed therein. These structural members 30 are also glued together at their end edges 32 to form panels which are quickly erected in a building structure, and these may also be provided with channel members at the ends thereof, but secured to a narrower connecting strip or wooden board, such as 37 secured to the floor structure 18, as shown in FIG. 1. A similar wooden board may be secured to the upper channel member. However, with the partition walls it may not be necessary to provide these channels in the opposed ends of these structural members and panels, and these may simply be retained in position by glueing the abutting side edge thereof to the vertical side walls and the lower edge to the floor. Also, the lower edges may be retained in place by securing quarter-round strips to the floor, such as shown at 38 in FIG. 3, on opposed sides of the panels formed by these structural members 30. The hollow spaces 31 and 31' within the structural members 30 may also be filled with an insulation material as previously described, although internally of the structure it is not necessary to provide thermal insulation. Still further, when assembling the members 30 to form panels, the double-ply side wall side can be alternated, as shown in FIG. 4A to 4D.

Referring now to FIGS. 6 and 7, there is shown the use of the structural members 10 in the construction of roof panels 23, or ceiling panels 29. As herein shown, the ceiling panels 29 are supported by brackets 28 or quarter-round strips, such as 38 shown in FIG. 3. They are glued or otherwise fastened to the vertical side wall panel 11 in a manner well known in the art.

As shown in FIG. 6 the roof panels 23 are supported on the top edge of the vertical panels 11, and more particularly on the rigid structural member 17'. When the roof panels are angulated to form a pitch roof, as herein shown, the structural wooden member 17' may be notched, such as at 40, and a further wedge wooden strip 41 may be positioned thereunder whereby to provide a good weight transfer and attachment between the roof panel 23 and the vertical wall panel 11. The roof panels 23 may be covered with an insulating and waterproof paper 42, as is well known in the art, and have shingles 43 secured thereto. Also, an eaves trough metal flashing 44 may be secured to the end of the panels to channel the water from the roof, and also to maintain the panels well secured in side-by-side relationship, and seal the ends thereof. This eaves trough molding is secured directly into the wooden piece 17 disposed in the end channel 16 of the panel.

FIG. 7 shows the construction of a roof apex connector 45 which is secured to the opposite ends of the roof panels 23 to maintain them at the proper pitch. This connector 43 is of generally V-shaped cross-section, and is provided with opposed securement flange walls 46 which are secured in the wooden beams 17' provided at the other end of the panels 23 by standard type fasteners 47. The V-shaped channel also defines a hollow inner area 48 which may be used to position cables or pipes 49, or even constitute a duct or contain a duct therein (not shown) for air-conditioning. A brace 50 is then positioned across the attachment walls 46 to maintain them in position and to resist compressive forces when a load is applied on the roof. A cap 51 is also secured over the open end of the V-shaped connector 45 to prevent ingress of water into the channel. A further brace 52 may be secured internally of this cap to provide added bracing. A sealing strip 53 is then secured in position also to provide exterior sealing and on which shingles are disposed. It is pointed that it is within the ambit of the present invention to cover any obvious modifications of this connector which is used to maintain the roof panels at a desired pitch, or in a horizontal plane depending on the roof structure desired.

Referring now to FIGS. 8A to 8E and 9, there is shown the method of forming the cardboard structural panels for the construction of cardboard building structures, and including the cardboard structural members 10 of the present invention. Firstly, it is necessary to construct the cardboard structural members 10, and this is done by a machine which performs the functions as illustrated in FIGS. 8A to 8E. Firstly, there is provided a core member which we will herein refer to as a carrier member 60, and about which is folded a rectangular corrugated cardboard sheet 61. It is pointed out that the carrier member 60 is of the same width as the structural members 17 utilized to fortify the end sections of the panel and attach them in a building structure. The end of the rectangular cardboard sheet 61 is placed against one of the elongated end walls 62 of the carrier member 60 and folded on its top wall 63. The cardboard is then folded against the opposed end wall 62' and over the opposed side wall 63'. The residual end portion 61' of the cardboard sheet is substantially equal to the height of the end wall 62 plus the thickness of the cardboard ply. At this position a jet 64 applies a glue strip on the inside surface of the end portion 61' which is then folded back over the first cardboard ply applied on the end wall 62. Thus, there is formed the cardboard structural member 10 having a double-ply end 10' and a single-ply end 10''.

After the cardboard structural member 10 is formed and while still maintaining the carrier member 60 therein, glue is applied to an end panel portion, for example end wall 10'', and the carrier member 60 and its surrounding cardboard sheet 61 is then disposed between two pressure plates 70 and 70' of a panel forming machine 69. The first carrier member is inserted with its end 10' in abutment with a transverse guide member 71 having a flat transverse abutment wall 72. A second carrier member and surrounding cardboard sheet is then introduced between the pressure plate 70 and 70' with its unglued end portion against the glued end portion of the previously inserted carrier member. This process is repeated until a complete panel is formed. Thereafter pressure is applied from the end wall of the last carrier member 60' to apply pressure against the glue seams. Transverse pressure may also be applied to the pressure plates 70 and 70' by suitable pressure applying means, herein illustrated by the symbol 73, and this pressure may be varied depending on the resistance required when displacing the carrier member and surrounding cardboard sheets between the plates. A piston head 74 provides this pressure and displacement of the carriers between the pressure plates 70 and 70'. After the cardboard structural members 10 have been pressurized within the panel forming machine 69, the piston 75 retracts the piston head 74, and the pressure is removed from the pressure plates. The carrier members 60 are then extracted by suitable pusher means from their respective surrounding cardboard sheets and the panel, which consists of cardboard structural members 10 glued end to end, extracted or removed by hand. By spring biasing the guide member 71 after the panel is formed, and removing the biasing pressure on the pressure plate 70 and 70', the panel can be automatically ejected from the panel forming machine. It is pointed out that by applying pressure on all four walls of each of the cardboard structural member forming the panel, a substantially perfectly shaped panel is produced.

FIG. 10 illustrates the construction of the dividing wall panel formed of the cardboard structural members 30, illustrated in FIGS. 4A to 4D. These are formed the same way by also using carrier members 70 but of smaller cross-section. These may be formed in the same panel forming machine but with the head of the guide member 71 changed, as well as the piston head 74, as these dividing wall panels are substantially narrower.

It is within the ambit of the present invention to cover any obvious modifications of the method described herein, provided such modifications fall within the scope of the appended claims. For example, after the panels are formed these could be immediately sprayed with a surface coating whereby to provide a finished exterior and/or interior wall surface. Also, the cardboard sheet 61 can be treated with a waterproofing solution prior to forming the cardboard structural members 10 or 30, or after the panels are formed. The hollow interior of these panels could also be injected with a foam-type insulating material immediately after the formation of the panel, or at any time prior to its assembly on site. It is also within the ambit of the present invention to cover any obvious modifications of the cardboard structural members 10 or 30 provided these fall within the scope of the appended claims.

I claim:

1. A cardboard structural member in the construction of building panels for walls, roofs, ceilings and the like, said panels having a plurality of said members retained side by side, said member comprising an elongated hollow channel member of rectangular cross-section formed of corrugated cardboard sheeting having at least two plies of corrugated glued cardboard treated with a water proofing substance, at least one of said opposed parallel walls having two superimposed glued layers of said cardboard entirely across said one wall for retaining said cardboard sheeting in said rectangular cross-section, said channel member having opposed parallel walls and being opened at its ends, one pair of said parallel walls terminating short of said ends to define a connecting channel across said ends between opposed parallel side walls for receiving a rigid structural member thereacross when assembling said panel to form a building structure.

2. A cardboard structural member as claimed in claim 1 wherein said one wall is an end wall of said opposed parallel wall.

3. A cardboard structural member as claimed in claim 1 wherein said corrugations in said two plies extend at right angles to one another to provide improved sound absorption of said hollow channel member.

4. A cardboard structural panel formed of at least two of said structural member as claimed in claim 1 wherein said structural panels are glued along an outside surface of like ones of said opposed parallel walls with their connecting channels axially aligned, said like ones of said parallel walls forming triple-layer vertical support walls.

5. A cardboard structural panel as claimed in claim 4 wherein said structural member is a rigid elongated structure edge member of rectangular cross-section secured across said axially aligned channel by fasteners extending from an outer surface of opposed walls of said structural panels into said elongated structural edge member.

6. A cardboard structural panel as claimed in claim 5 wherein said structural edge member is an elongated straight wooden beam of rectangular cross-section.

7. A cardboard structural panel as claimed in claim 6 wherein said panels are secured over a floor structure to form vertical walls of a building, said channel in a lower end of said panels being secured to a structural edge member previously secured to said floor structure, and further structural edge members secured in said channel in a top end of said panels, and roof panels constructed of a plurality of cardboard structural members glued side by side and supported on said further structural edge members secured in said channels in said top ends of a plurality of said vertical wall panels.

8. A cardboard building structure formed with structural panels as defined in claim 7 wherein said panels have solid opposed walls defining inner and outer walls of said structure, and cut-outs in said opposed inner and outer walls defining openings to form doors, windows and other openings necessary in a building structure.

9. A cardboard building structure as claimed in claim 8 wherein said window and door openings are provided with horizontal sills by notching transverse opposed walls of said panels to form further channels to receive and support a further structural edge member of rectangular cross-section horizontally and flush with a cut-out edge of said window or door opening.

10. A cardboard building structure as claimed in claim 9 wherein said further structural edge member is an elongated straight wooden beam of rectangular cross-section, said beam extending across said opening and seated in said further channel and retained by fasteners extending in said wooden beam from the outer surface of adjacent inner and outer wall portions.

11. A cardboard building structure as claimed in claim 7 wherein a thermal insulating substance is disposed in said panel hollow channel members to provide added insulation prior to securing said further structural edge members in said top channel.

12. A cardboard building structure as claimed in claim 7 wherein said roof panels comprise two or more panels having a common opposed end with said structural edge member secured in the channel thereof interconnected at an angle to one another by a roof apex connector to define a pitch roof, said connector being a V-shaped connector having securement flange walls secured to said edge member in said opposed end, an outer cover for securement across an open top end of said connector exteriorly of said pitch roof.

13. A cardboard building structure as claimed in claim 12 wherein said connector forms a hollow channel conduit for housing electrical conduits, water conduits, or constituting an air vertilating conduit.

* * * * *